United States Patent [19]

Luedtke

[11] Patent Number: 4,919,317

[45] Date of Patent: Apr. 24, 1990

[54] UTILITY BELT HOOK

[76] Inventor: Gary D. Luedtke, 2226 N. 64th St., Wauwatosa, Wis. 53213

[21] Appl. No.: 174,594

[22] Filed: Mar. 29, 1988

[51] Int. Cl.[5] ..... A45F 5/00; A46B 17/00; B05C 21/00; B25F 1/00

[52] U.S. Cl. ..... 224/151; 7/105; 7/152; 224/252; 224/255

[58] Field of Search ..... 224/151, 224, 225, 226, 224/252, 255, 268, 269, 904; 211/65, 66, 70.1; 248/301, 303, 304, 309.2, 339, 359 G, 359 I, 110, 231.8; 254/21, 25; 7/105, 151, 152, 166

[56] References Cited

U.S. PATENT DOCUMENTS

| | | | |
|---|---|---|---|
| 259,245 | 6/1882 | Thomas | 7/105 |
| 429,515 | 6/1890 | Fred | 7/105 |
| 778,272 | 12/1904 | Roop | 248/309.2 X |
| 1,779,293 | 10/1930 | Rodgers | 7/105 X |
| 2,524,475 | 10/1950 | Renz | 7/151 X |
| 2,555,810 | 6/1951 | Parsons | 248/110 |
| 2,618,419 | 11/1952 | Vanish | 224/252 |
| 2,985,349 | 5/1961 | McGuire | 224/268 |
| 3,285,482 | 11/1966 | Bedsaul, Sr. | 224/269 X |
| 3,432,875 | 3/1969 | Edelson et al. | 248/359 I X |
| 3,493,152 | 2/1970 | Ort | 224/268 X |
| 4,186,903 | 2/1980 | Fazakerley | 248/231.8 X |
| 4,587,818 | 5/1986 | Griffin | 224/252 X |

FOREIGN PATENT DOCUMENTS

| | | | |
|---|---|---|---|
| 670342 | 9/1963 | Canada | 7/105 |
| 472275 | 12/1950 | Italy | 7/152 |

*Primary Examiner*—Harvey C. Hornsby
*Assistant Examiner*—Scott J. Haugland
*Attorney, Agent, or Firm*—Andrus, Sceales, Starke & Sawall

[57] ABSTRACT

A utility hook for a painter or the like includes a clip having a pair of downwardly extending member defining a belt-receiving space therebetween for attaching the hook to a painter's belt. An upwardly extending member is connected to the outer of the downwardly extending members, and defines a bail-receiving area for receiving the bail of a paint bucket therein so as to suspend the paint bucket from the hook. The upper end of the upwardly extending member has a shoulder for receiving and retaining a paint brush thereon by engagement with an opening conventionally provided in the handle of a paint brush. The upper end of the upwardly extending member has an indentation for use in prying the lid from a paint bucket, and the lower end of the inner clip member has a slot forming a claw for use in pulling nails from a wall prior to finishing.

8 Claims, 1 Drawing Sheet

UTILITY BELT HOOK

BACKGROUND AND SUMMARY

This invention relates to tools, and more particularly to a multipurpose tool for use in painting or the like.

When painting or otherwise finishing a wall, it is often necessary to use a ladder to reach high areas. When this is done, climbing up or down the ladder with painting equipment in hand can be a difficult task.

It is an object of the invention to provide a means for carrying painting or other finishing equipment while leaving a person's hands free. In accordance with the invention, a utility hook for a painter or the like includes a clip adapted for attachment to a person's belt. The clip has first and second downwardly extending members connected together at their upper ends, with the downwardly extending members defining a belt-receiving space therebetween. An upwardly extending member is connected to the outwardly facing downwardly extending member, and defines a bail-receiving area therebetween adapted to receive the bail of a paint bucket or the like. In this manner, the paint bucket can be carried on the person while leaving the hands free. The upstanding member is preferably disposed at an acute angle relative to the outwardly facing downwardly extending member, and the vertex of the acute angle is adapted to receive and retain the bail of the paint bucket, for suspending the paint bucket therefrom. The upwardly-extending member is provided toward its upper end with receiving means for receiving and retaining a paint brush or the like thereon. In one embodiment, the receiving means comprises a portion at the upper end of the upstanding member being provided with a narrowed transverse dimension relative to the remainder of the upstanding member. A shoulder is thus formed between the receiving means and the lower portion of the upstanding member. The narrowed portion of the upstanding member is adapted to mate with a hole conventionally provided in the end of a paint brush handle for retaining the paint brush thereon. The upper end of the upwardly extending member may be provided with an opening means, such as indentation across its width, for use in opening a paint bucket. A claw, comprising a substantially V-shaped slot formed in the lower end of the inner downwardly extending member, is adapted for use in pulling nails or the like from the wall prior to finishing.

The invention thus provides a utility hook which performs numerous functions and which can be constantly retained at the ready on the painter's belt for use as needed.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
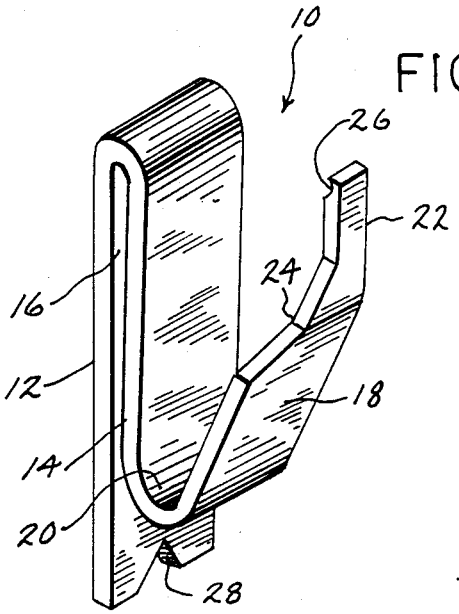
FIG. 1 is an isometric view of the utility hook of the invention.

As shown in FIG. 1, a painter's utility hook 10 includes a clip portion having an inner downwardly extending member 12 and an outer downwardly extending member 14. Inner and outer downwardly extending members 12, 14 are connected together at their upper ends, so as to form a belt-receiving space 16 therebetween.

An upwardly extending member 18 is connected to the lower end of outer downwardly extending member 14. Upwardly extending member 18 is disposed at an acute angle relative to downwardly extending member 14, to form a bail-receiving area 20 therebetween. Upwardly extending member 18 is provided at its upper end with a substantially vertical portion 22.

A cutout is provided in the upper end of upwardly extending member 18 adjacent vertical portion 22, forming a shoulder 24. In this manner, the upper end of upwardly extending member 18 has a reduced transverse dimension relative to the lower end thereof.

An indentation 26 is formed at the upper tip of vertical portion 22, and extends across its width. Indentation 26 is adapted for use as an opening means for removing the lid from a paint bucket or the like.

The lower end of inner downwardly extending member 12 may include a V-shaped slot 28. V-shaped slot 28 forms a claw at the lower end of downwardly extending member 28, for use in pulling nails from a wall of the like prior to finishing.

Figure 2:
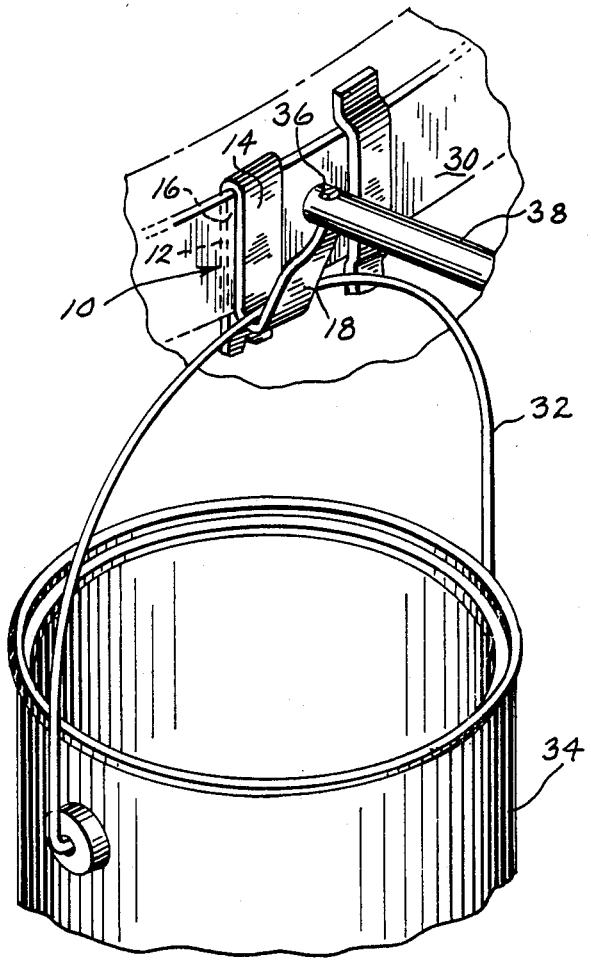
FIG. 2 is a view showing the utility hook of FIG. 1 in use.

With reference to FIG. 2, hook 10 is adapted for attachment to a belt 30 by engaging belt 30 in belt-receiving space 16 by downward movement of inner and outer downwardly extending members 12, 14 thereon. Belt-receiving space 16 preferably has a width adapted to accommodate most belt thicknesses. As shown, outer downwardly extending member 14 may be disposed relative to inner downwardly extending member 12 so that the mouth of belt-receiving space 16 is somewhat narrower than the width at the upper end of belt-receiving space 16. Once in place on belt 30, utility hook 10 is adapted to receive a bail 32 of a paint bucket 34 by placement of bail 32 within bail-receiving area 20 of hook 10. When so positioned, bucket 34 is constantly at the ready at the painter's side. Additionally, the hook formed by outer downwardly extending member 14 and upwardly extending member 18 may be utilized for retaining a roll of masking tape or the like thereon.

Upper portion 22 of upwardly extending member 18 is adapted to receive an opening 36 conventionally provided in the end of a paint brush handle 38, as shown. The underside of paint brush handle 38 engages shoulder 24 so as to prevent handle 38 from sliding downwardly. In this manner, paint brush handle 38 extends substantially perpendicularly relative to the painter when engaged with portion 22 of upwardly extending member 18. The paint brush can conveniently be so placed during climbing up or down a ladder to free of the painter's hands, and otherwise when not in use.

Figure 3:
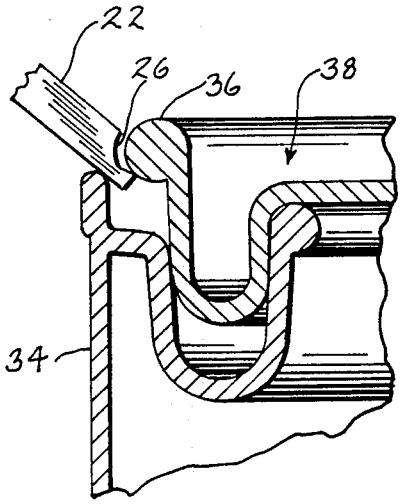
FIG. 3 is a partial sectional view showing the opening means of the invention in use.

As shown in FIG. 3, slot 26 formed in the upper tip of upwardly extending member 18 is adapted to engage a rim 36 provided on a paint bucket lid 38, to remove lid 38 as is known. Upper portion 22 of upwardly extending member 18 is used to pry lid 38 off of bucket 34 to thereby open bucket 34.

It is contemplated that hook 10 will be kept on the painter's person at most times during the work day. Thus, when the painter is preparing the walls for finishing, hook 10 is available for use as a nail puller by utilizing V-shaped slot 28.

As explained, utility hook 10 performs several functions while maintaining a compact and non-obtrusive design.

Various alternatives and modifications are contemplated as being within the scope of the following claims particularly pointing out and distinctly claiming the invention.

I claim:

1. A utility hook for a painter or the like, comprising:

a clip adapted for attachment to a belt or the like, said clip including first and second downwardly extending members connected together toward their upper ends, said first and second downwardly extending members defining a belt-receiving space therebetween;

an upwardly extending member connected to said second downwardly extending member and defining a bail-receiving area therebetween, said bail-receiving area being adapted to receive the bail of a paint bucket or the like, said upwardly extending member being provided with receiving means for receiving and retaining a paint brush or the like thereon; and claw means for use in pulling nails or the like, said claw means comprising a substantially V-shaped slot provided at the lower end of said first downwardly extending member.

2. A utility hook for a painter or the like, comprising:

a clip adapted for attachment to a belt or the like, said clip including first and second downwardly extending members connected together at their upper ends, said first and second downwardly extending members defining a belt-receiving space therebetween;

an upwardly extending member connected to the lower end of said second downwardly extending member, said upwardly extending member being disposed at an acute angle relative to said second downwardly extending member, with the vertex of said acute angle being adapted to receive the bail of a paint bucket or the like for suspending said paint bucket or the like therefrom;

a substantially V-shaped slot provided at the lower end of said first downwardly extending member, said V-shaped slot being disposed below the connection of said upwardly extending member to said second downwardly extending member and being adapted for use in pulling nails or the like; and receiving means comprising a narrowed portion provided at the upper end of said upwardly extending member relative to the lower end of said upwardly extending member, with a shoulder formed adjacent said narrowed portion for receiving and retaining a paint brush thereon by engagement with an opening provided in the handle of said paint brush.

3. A one-piece utility belt hook, comprising:

a first downwardly extending section;

a second downwardly extending section;

said first and second downwardly extending sections being joined at their upper ends and defining a belt-receiving space therebetween;

an upwardly extending section joined at its lower end with said second downwardly extending section so as to form a bail-receiving area between said upwardly etending section and said second downwardly extending section for receiving the bail of a paint bucket or the like;

retaining means formed integrally with said upwardly extending section and including a portion adapted to engage an opening provided in the handle of a paint brush or the like for retaining said paint brush or the like on said hook and;

a substantially V-shaped slot provided at the lower end of said first downwardly extending section for use in pulling nails or the like.

4. The utility hook of claim 3, wherein said first downwardly extending section is formed to provide a substantially constant width throughout its length, with the width of said first downwardly extending section being substantially equal to the width of said second downwardly extending section.

5. The utility hook of claim 3, wherein said first downwardly extending section has a length slightly greater than that of said second downwardly extending section.

6. The utility hook of claim 3, wherein said retaining means is formed such that, when said paint brush or the like is engaged therewith, said paint brush or the like projects outwardly from said hook.

7. The utility hook of claim 6, wherein said retaining means comprises an upstanding narrowed portion formed at the upper end of said upwardly extending section and adapted for insertion into an opening formed in the handle of said paint brush or the like, and a shoulder disposed below said upstanding portion for engaging the handle of said paint brush or the like for maintaining said paint brush or the like. in an outwardly projecting fashion relative to said hook.

8. The utility hook of claim 7, further comprising an indentation extending transversely across the width of said upstanding narrowed portion at its upper end for use in removing the lid from a paint can or the like.

* * * * *

UNITED STATES PATENT AND TRADEMARK OFFICE

CERTIFICATE OF CORRECTION

PATENT NO. : 4,919,317

DATED : April 24, 1990

INVENTOR(S) : Gary D. Luedtke

It is certified that error appears in the above-identified patent and that said Letters Patent is hereby corrected as shown below:

Claim 7, Col. 4, Line 47; After "like" delete --- . ---.

Signed and Sealed this

Twenty-seventh Day of August, 1991

*Attest:*

*Attesting Officer*

HARRY F. MANBECK, JR.

*Commissioner of Patents and Trademarks*